US008256173B2

(12) United States Patent
Sarkisian et al.

(10) Patent No.: US 8,256,173 B2
(45) Date of Patent: Sep. 4, 2012

(54) ENVIRONMENTALLY SUSTAINABLE FORM-INCLUSION SYSTEM

(75) Inventors: Mark P. Sarkisian, San Anselmo, CA (US); Craig W. Hartman, Corte Madera, CA (US)

(73) Assignee: Skidmore, Owings & Merrill LLP, New York, NY (US)

( * ) Notice: Subject to any disclaimer, the term of this patent is extended or adjusted under 35 U.S.C. 154(b) by 77 days.

(21) Appl. No.: 12/313,133

(22) Filed: Nov. 17, 2008

(65) Prior Publication Data

US 2010/0122504 A1 May 20, 2010

(51) Int. Cl.
*E04C 5/08* (2006.01)

(52) U.S. Cl. ..... 52/223.6; 52/404.1; 52/405.1; 52/414; 52/576; 52/577; 428/903.3

(58) Field of Classification Search ..... 52/DIG. 9, 52/223.6, 414, 405.1, 426, 431, 432, 576, 52/577; 428/903.3

See application file for complete search history.

(56) References Cited

U.S. PATENT DOCUMENTS 1,465,653 A * 8/1923 Olander ..... 52/382
1,477,520 A * 12/1923 Pittman ..... 52/576
1,753,776 A * 4/1930 De Vilbiss ..... 52/608
3,152,421 A * 10/1964 Middendorf ..... 52/223.6
3,229,437 A * 1/1966 Adie ..... 52/576
3,788,012 A * 1/1974 Arnold ..... 52/73
3,857,215 A * 12/1974 Moore ..... 52/259
3,858,376 A * 1/1975 Moore ..... 52/382
3,952,529 A 4/1976 Lefever
3,979,870 A * 9/1976 Moore ..... 52/577
3,982,362 A * 9/1976 Moore ..... 52/91.2
4,068,429 A * 1/1978 Moore ..... 52/210
4,084,363 A * 4/1978 Moore ..... 52/309.4
4,394,201 A * 7/1983 Haeussler ..... 156/73.6
4,979,992 A * 12/1990 Bache ..... 106/644
5,088,253 A * 2/1992 Christ ..... 52/309.7

(Continued)

OTHER PUBLICATIONS

Bag-a container or receptacle of plastic capable of being closed at the mouth. bag. (n. d.). Dictionary.com Unabridged. Retrieved Apr. 26, 2010, from Dictionary.com website: http://dictionary.reference.com/browse/bag.*

(Continued)

*Primary Examiner* — Brian Glessner
*Assistant Examiner* — Joshua Ihezie
(74) *Attorney, Agent, or Firm* — SNR Denton US LLP

(57) ABSTRACT

An environmentally sustainable form-inclusion system that can be utilized in reinforced concrete structures. A goal of this invention is to provide structural systems that achieve the highest level of environmental sustainability by minimizing the structure's carbon footprint and embodied energy. This engineered form-inclusion system uses materials that might otherwise become waste in landfills. The system is designed to significantly reduce raw materials, labor for placement, and transportation of material for building construction. Materials used in this engineered system, that might otherwise be placed in landfills, include but are not limited to plastic bottles, bags, waste Styrofoam, packing materials, rubber tires, and other similar waste materials, preferably compressed or assembled into controlled shapes. The shapes of these forms can be spherical, square, rectangular, cylindrical, or any other, and are specifically engineered to provide form inclusions to significantly reduce the material (e.g., concrete and reinforcing steel) required for the structure, and to reduce the overall structural weight (seismic mass), thereby relieving demand on the structure's lateral and gravity systems. The inclusion system described herein allows for flat forming of horizontal framing throughout the structure, greatly reducing the material required for forming (limited beams/drops).

15 Claims, 7 Drawing Sheets

U.S. PATENT DOCUMENTS

| | | | | |
|---|---|---|---|---|
| 5,103,616 | A * | 4/1992 | Nordberg | 52/585.1 |
| 5,172,528 | A * | 12/1992 | Clarke | 52/198 |
| 5,214,897 | A * | 6/1993 | Nordberg | 52/585.1 |
| 5,391,226 | A * | 2/1995 | Frankowski | 106/696 |
| 5,396,747 | A * | 3/1995 | Breuning | 52/516 |
| 5,398,472 | A * | 3/1995 | Eichelkraut | 52/443 |
| 5,599,599 | A * | 2/1997 | Mirmiran et al. | 428/36.3 |
| 5,797,230 | A * | 8/1998 | Lassen | 52/323 |
| 5,833,394 | A | 11/1998 | McCavour | |
| 6,161,355 | A * | 12/2000 | Gratt | 52/561 |
| 6,293,065 | B1 * | 9/2001 | Suzuki et al. | 52/315 |
| 6,470,640 | B2 * | 10/2002 | Ytterberg | 52/414 |
| 6,718,722 | B2 * | 4/2004 | Worrell et al. | 52/741.13 |
| 7,067,588 | B2 * | 6/2006 | Ritter et al. | 525/268 |
| 7,540,121 | B2 * | 6/2009 | Haeussler | 52/323 |
| 2004/0154263 | A1 | 8/2004 | Li et al. | |
| 2005/0284088 | A1 * | 12/2005 | Heath | 52/741.1 |
| 2007/0062143 | A1 * | 3/2007 | Noushad | 52/426 |
| 2008/0060294 | A1 * | 3/2008 | Cox et al. | 52/284 |
| 2008/0145580 | A1 * | 6/2008 | McAllister et al. | 428/36.4 |
| 2008/0263989 | A1 * | 10/2008 | Bull | 52/600 |
| 2009/0178590 | A1 * | 7/2009 | Mitchell et al. | 106/644 |

OTHER PUBLICATIONS

Sonoco, "Sonovoid® Fibre Tubes", product brochure, first publication date unknown, brought to the attention of E. Radio on Feb. 19, 2009.

Build.ie, "Bubbledeck UK Ltd Structural Flooring System", Channel Islands, UK, Website pp. 1-4, printed Jul. 31, 2008: http://www.build.ie/company_400107.htm.

Spancrete Manufacturers Association, "Spancrete Hollowcore", Website page printed Feb. 9, 2009: http://www.spancrete-sma.com/ps_hollowcore.php.

International Search Report corresponding to PCT/US09/063953 dated Jan. 6, 2010.

* cited by examiner

ENVIRONMENTALLY SUSTAINABLE FORM-INCLUSION SYSTEM

TECHNICAL FIELD

The present invention pertains to concrete construction of buildings or other structures. In particular, the sustainable form-inclusion system described herein is designed to replace concrete not needed in the building structure, while using waste material that might otherwise be placed in landfills. In framed structures, the inclusion system is placed in areas of the structure that are dominated by bending rather than shear behavior. Concrete typically placed in these areas, either cast-in-situ or precast, provides little or no structural benefit, only adding weight to the structure. The present inclusion system preferably uses recycled material assembled and incorporated into the structure, with little or no additional energy required to reconfigure the material before placement in the structure.

BACKGROUND ART

Structures have been constructed, and are being constructed daily, with concrete. These structures are constructed on-grade as well as being suspended in framed structures. These structures must be designed to resist gravity loads as well as loads caused by wind and seismic events. In many areas of the structure, concrete is placed during the process of building, but because of the location where the concrete is placed, the concrete provides no structural benefit.

Precast long-span framing systems frequently use shapes for framing elements that optimize the structure. This can be accomplished by T-shaped framing elements or slab systems with hollow cores. The hollow core planking system Spancrete Hollowcore Plank uses open sections along the length of the structural element to eliminate the need for concrete in center areas of the section while reducing weight.

Inclusion systems have been introduced into both on-grade structures and framed structures. In many cases, lost forms are introduced. These forms mostly consist of elements that frame voids where concrete is not required. The framing for these voids has included framed wood, fabricated Styrofoam or similar materials, and some plastics. In these cases, raw materials are used to create the inclusion.

Other systems have introduced inclusions into the structure during the casting process. These inclusions have consisted of products such as "Sonovoid"—a capped Sonotube system. Other systems such as Bubbledeck include preformed, fabricated balls that require a considerable amount of embodied energy to create the inclusion elements.

What is needed is an environmentally sustainable form-inclusion system. That need is satisfied by the present invention.

DISCLOSURE OF INVENTION

The present invention is an environmentally sustainable form-inclusion system that can be utilized in concrete structures, and in other structures as well. The sustainable form-inclusion system can be incorporated into steel and/or composite reinforced concrete structures, either suspended or constructed on-grade.

The inclusion system may be placed in structures that are or cast-in-situ or are partially or wholly precast. The inclusion system is placed to eliminate concrete where it is not required for the structure, and to utilize waste products that might otherwise be placed in landfills.

In many structures, there are areas that require little or no concrete, with the concrete being placed only for ease of construction. In addition, in order to achieve long structural spans without vertical support (at columns or walls), beams and girders are typically used for framing. Flat reinforced concrete slabs usually span between framing members. These structures require a considerable amount of material and labor to construct, each requiring special formwork systems to be assembled and disassembled. These framing members usually create obstacles in occupied structures, particularly related to building service system distribution and clear heights for ceilings. In addition, future space partitions are difficult to incorporate because of geometric coordination.

The present sustainable form-inclusion system provides voids within the structure, allowing for flat-formed bottoms to the structure while creating a built-in framing system without the rigorous effort of fabricating internal forms. Long-span structural conditions can be achieved with total structural depth less than that for a conventionally framed beam and slab structure. As with beam and slab construction, the present sustainable form-inclusion structure may incorporate conventional mild reinforcing steel and/or high-strength pre-stressed cables.

The present sustainable form-inclusion system may be arranged in various geometries within the concrete structure. In a framed structure, the inclusion system may be placed either in a two-way cellular layout or a one-way continuous cell layout, or a combination of both. In a two-way slab system, the concrete placed in two intersecting middle strips of the structure, generally the central area of the structure located halfway between vertical supports, is an area primarily subject to bending, with a small magnitude of shear due to gravity and superimposed loads. This area requires concrete to provide bonding and continuum for reinforcing steel and only a minimal amount of shear resistance, since the shear load is nearly non-existent. The present inclusion system is placed with high concentration in these areas. On the other hand, in this same system, concrete is essential for the structure in a two-way slab framing system near vertical supports. Here shear is highest, and concrete is required to transfer load from the frame system to the vertical support. The inclusion system is placed with relatively low concentration in these areas. In a similar manner, the sustainable form-inclusion system can be placed in one-way slab or beam systems, where the highest concentrations of the form-inclusion are located in areas of low shear forces, typically located away from supports, with the lowest concentrations near supports where shear is the highest.

The reduction in the structure's weight not only reduces the amount of concrete, but also reduces the amount of reinforcing steel or pre-stressing cables required. In addition, the structural demand to resist gravity loads is reduced. Since the weight is reduced, there is a reduction in seismic mass. Applied lateral loads from seismic events are less. The demand on vertical load carrying elements, such as columns and walls, is less. The demand on the foundation systems are also less, leading to less material required for construction. The present form-inclusion system can be placed in framed floor slabs, beams, columns, walls, fills, structures on grade, etc.

The fill used in the present inclusion system can include, but is not limited to, plastic bottles, bags, waste Styrofoam, packing materials, rubber tires, and other similar waste materials. These materials may be compressed or assembled into controlled shapes. The shapes of these forms can be spherical, square, rectangular, cylindrical; similar to spherical, square, rectangular, or cylindrical; or any other. Waste materials may be collected and assembled into these forms without reconfiguration. Plastic water bottles with caps create an internal air chamber with only partial compression when hydrostatic load due to concrete placement is applied, and can be assembled into units of an engineered geometry, tied, and placed in the structure. Plastics, rubber tires, or similar materials can be partially compressed, bundled, and wrapped in plastic or shrink-wrapped for placement in the structure. The plastic wrapping, shrink wrap, or similar process, maintains the general shape of the inclusion system, and prevents concrete from entering the inclusion system during the concrete pour.

The present light-weight inclusion system has the tendency to become buoyant during the placement of concrete. Therefore, the inclusion system must be restrained vertically during concrete pours, whether the pour is performed on-site or in precast plants. This restraint is achieved by using form-ties or similar devices commonly used in concrete construction.

Fire rating of suspended concrete framing systems is achieved through providing minimum concrete cover to all reinforcing, and by providing an overall framed assembly that meets fire rating requirements.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
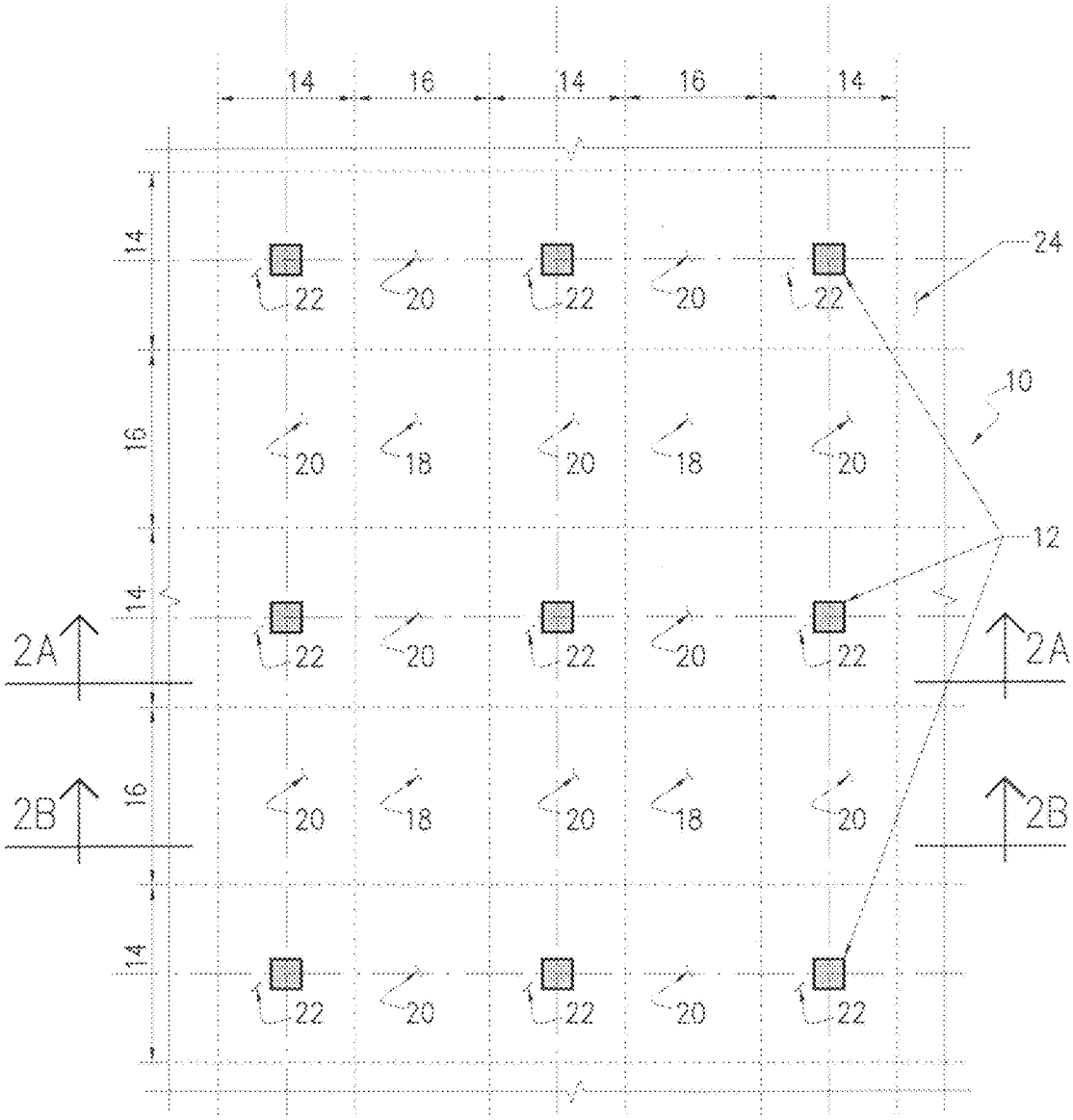
FIG. 1 is an overall top view of a framed reinforced concrete structure including embodiments of the sustainable form-inclusion system 10 of the present invention.

FIG. 1 is an overall top view of a framed reinforced concrete structure including embodiments of the present environmentally sustainable form-inclusion system 10. The reinforced concrete structure can comprise concrete reinforced with steel rebars, a combination of reinforced concrete and structural steel, and/or one or more composite materials.

As seen in FIG. 1, the sustainable form-inclusion system 10 consists of a reinforced concrete slab 24 (typically used as a floor in a building) supported by reinforced concrete columns 12. A plurality of form-inclusion system embodiments 30 are embedded within slab 24. The reinforced concrete slab 24 spans in two directions, efficiently supporting gravity loads and transferring those loads to the columns 12. The magnitudes of the shear and bending moments within the reinforced concrete slab 24 vary. We have defined strips 14, 16 within the slab 24 that correspond to the relative magnitudes of the shear and bending moments. Each strip 14 is defined as a column strip, and each strip 16 is defined as a middle strip. Zones 18, 20, and 22 are defined in terms of the relative magnitudes of the shear and bending moments. Considering applied gravity loads, Zone 18 corresponds to the relatively greatest positive bending moment and the relatively least shear, Zone 20 corresponds to an intermediate bending moment and an intermediate shear, and Zone 22 corresponds to the relatively greatest negative bending moment and the relatively greatest shear. The relatively greatest concentration of sustainable form-inclusion system embodiments are placed in Zone 18, a moderate concentration of sustainable form-inclusion system embodiments are placed in Zone 20, and the relatively least concentration of sustainable form-inclusion system embodiments are placed in Zone 22.

Figure 2A:
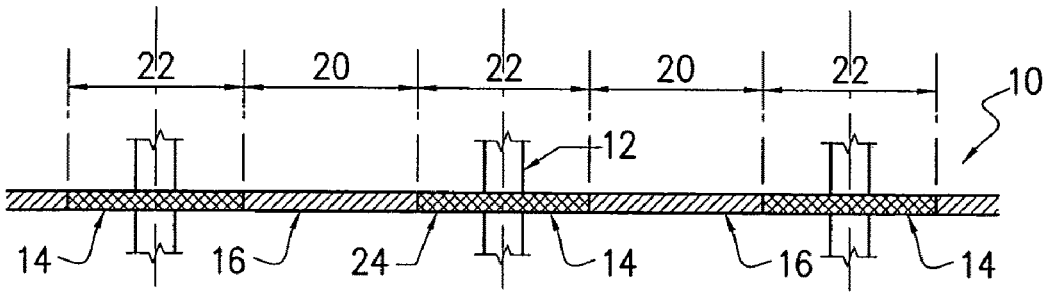
FIG. 2A is a cross-sectional view, taken through view lines 2A, of the framed reinforced concrete structure illustrated in FIG. 1.

FIG. 2A is a cross-sectional view of the framed reinforced concrete structure, including embodiments 30 of the sustainable form-inclusion system 10. As seen in FIG. 2A, the sustainable form-inclusion system 10 consists of a reinforced concrete slab 24 supported by reinforced concrete columns 12. The magnitudes of the shear and bending moments within the reinforced concrete slab 24 vary. Therefore, we have defined strips within the slab 24 that correspond to the magnitudes of the shear and bending moments. Strip 14 illustrated in this cross-sectional view is defined as a column strip, and strip 16 is defined as a middle strip. Zones 20 and 22 define areas where the magnitudes of the shear and bending moments vary. Zone 20 corresponds to an intermediate bending moment and an intermediate shear, and Zone 22 corresponds to the relatively greatest negative bending moment and the relatively greatest shear. A moderate concentration of sustainable form-inclusion system embodiments 30 are thus placed in Zone 20, and a lesser concentration of sustainable form-inclusion system embodiments 30 are placed in Zone 22.

Figure 2B:
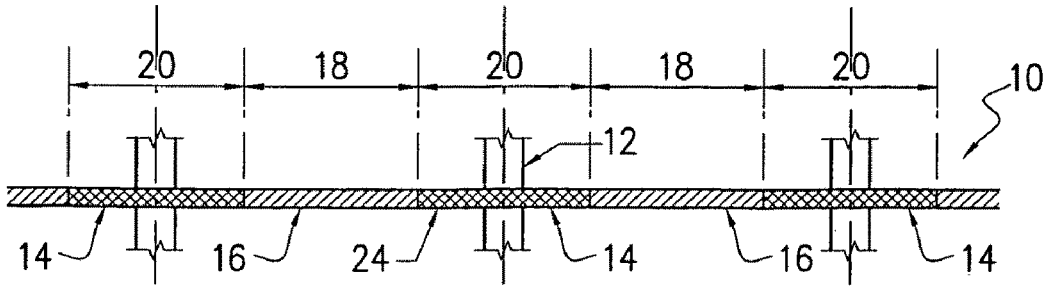
FIG. 2B is a cross-sectional view, taken through view lines 2B, of the framed reinforced concrete structure illustrated in FIG. 1.

FIG. 2B is another cross-sectional view of the framed reinforced concrete structure, including embodiments 30 of the sustainable form-inclusion system 10. As seen in FIG. 2B, the sustainable form-inclusion system 10 consists of a reinforced concrete slab 24 supported by reinforced concrete columns 12. The magnitudes of the shear and bending moments within the reinforced concrete slab 24 vary. Therefore, we have defined strips within the slab 24 that correspond to the magnitudes of the shear and bending moments. Strip 16 illustrated in this cross-sectional view corresponds to a middle strip, and strip 14 is defined as a column strip. Zones 18 and 20 define areas where the magnitudes of the shear and bending moments vary. Zone 18 corresponds to the relatively greatest positive bending moment and the relatively least shear, and Zone 20 corresponds to an intermediate bending moment and an intermediate shear. A relatively great concentration of sustainable form-inclusion system embodiments 30 are therefore placed in Zone 18, and a moderate concentration of sustainable form-inclusion system embodiments 30 are placed in Zone 20.

Figure 3:
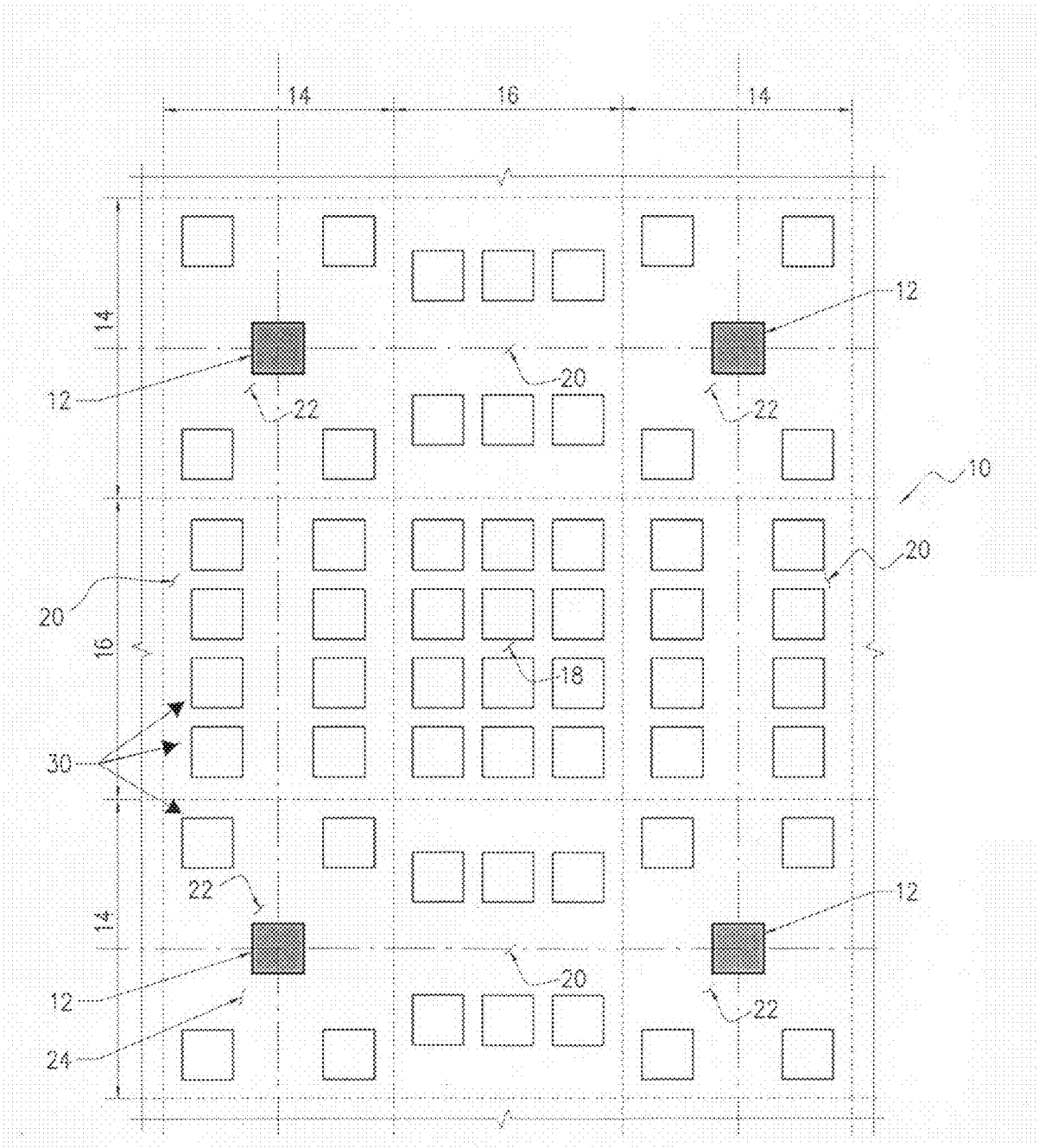
FIG. 3 is an exploded top view of a sustainable form-inclusion system for the framed reinforced concrete structure illustrated in FIG. 1.

FIG. 3 is an exploded top view of the sustainable form-inclusion system 10 for one bay of the framed reinforced concrete structure illustrated in FIG. 1. As seen in FIG. 3, sustainable form-inclusion system 10 consists of a reinforced concrete slab 24 supported by reinforced concrete columns 12. The reinforced concrete slab 24 spans in two directions, efficiently supporting gravity loads and transferring those loads to the columns 12. The magnitudes of the shear and bending moments within the reinforced concrete slab 24 vary. Therefore, we have defined strips 14, 16 within the slab 24 that correspond to the relative magnitudes of the shear and bending moments. Each strip 14 is defined as a column strip, and each strip 16 is defined as a middle strip. Zones 18, 20, and 22 are defined in terms of the relative magnitudes of the shear and bending moments. Zone 18 corresponds to the relatively greatest positive bending moment and the relatively least shear, Zone 20 corresponds to an intermediate bending moment and an intermediate shear, and Zone 22 corresponds to the relatively greatest negative bending moment and the relatively greatest shear. The greatest concentration of sustainable form-inclusion system embodiments are therefore placed in Zone 18, a moderate concentration of sustainable form-inclusion system embodiments are placed in Zone 20, and the least concentration of sustainable form-inclusion system embodiments are placed in Zone 22. Each sustainable form-inclusion system embodiment 30 is placed in a concentration that corresponds to the magnitudes of the bending moment and shear that exist within the corresponding zone of the reinforced concrete slab 24.

Figure 4A:
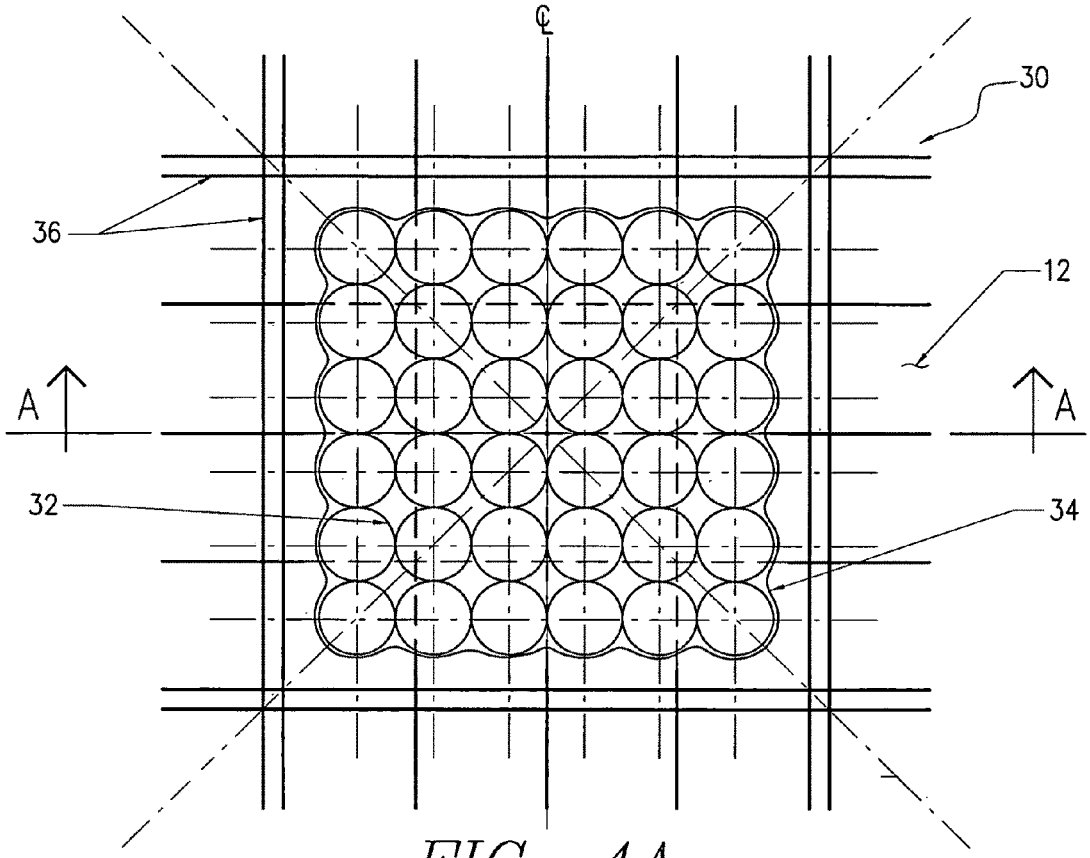
FIG. 4A is an exploded top view detail of a sustainable form-inclusion system embodiment 30 illustrated in FIG. 3.

FIG. 4A is an exploded top view detail of a sustainable form-inclusion system embodiment 30 illustrated in FIG. 3. The sustainable form-inclusion system embodiment 30 is placed in the reinforced concrete slab 24. Recycled material 32 is placed within a framework of reinforcing steel 36. Reinforcing steel 36 is placed above, below, and on each side of the form-inclusion system embodiment 30. Plastic shrink wrap 34 encapsulates the recycled material 32, including sides, top, and bottom.

Figure 4B:
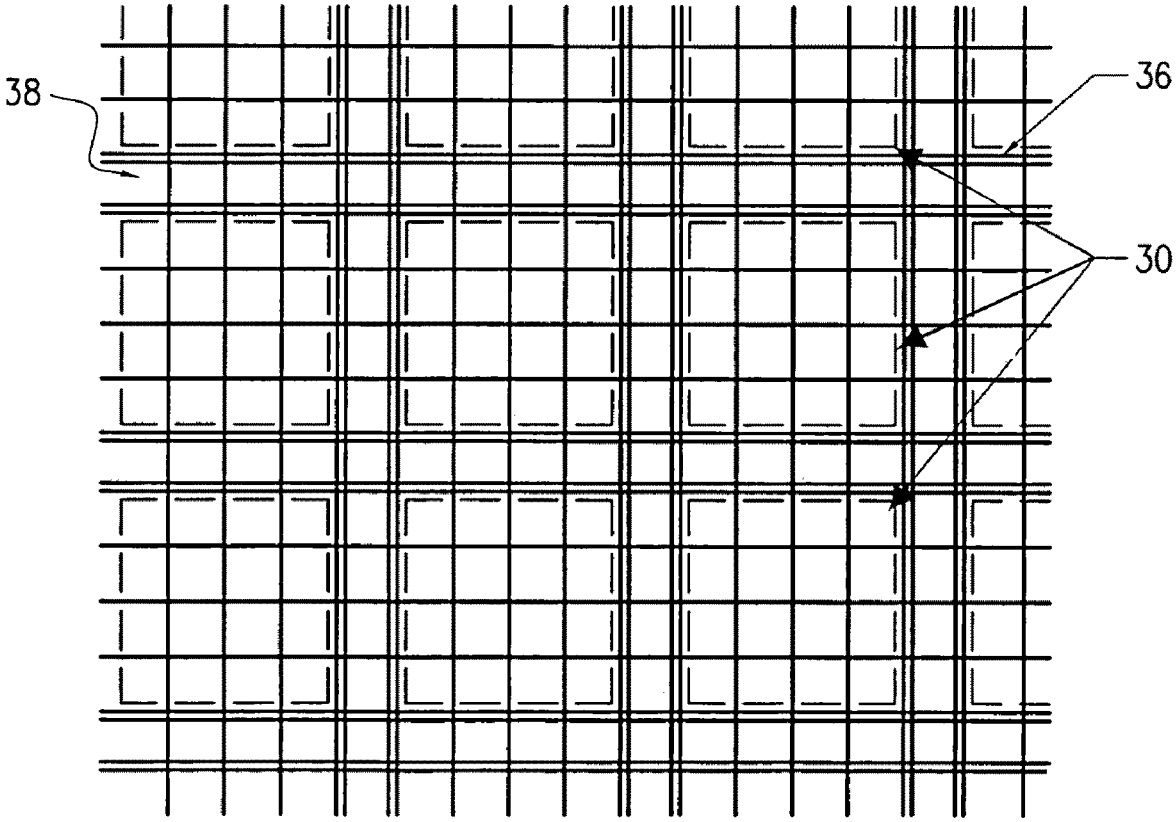
FIG. 4B is a top view detail of reinforcing steel used in conjunction with a sustainable form-inclusion system 10 illustrated in FIGS. 1 and 3.

FIG. 4B is a top view detail of a reinforcing steel system 38 used at the sustainable form-inclusion system embodiment illustrated in FIG. 4A. Reinforcing steel 36 is placed above, below, and on each side of each form-inclusion system embodiment 30.

Figure 5A:
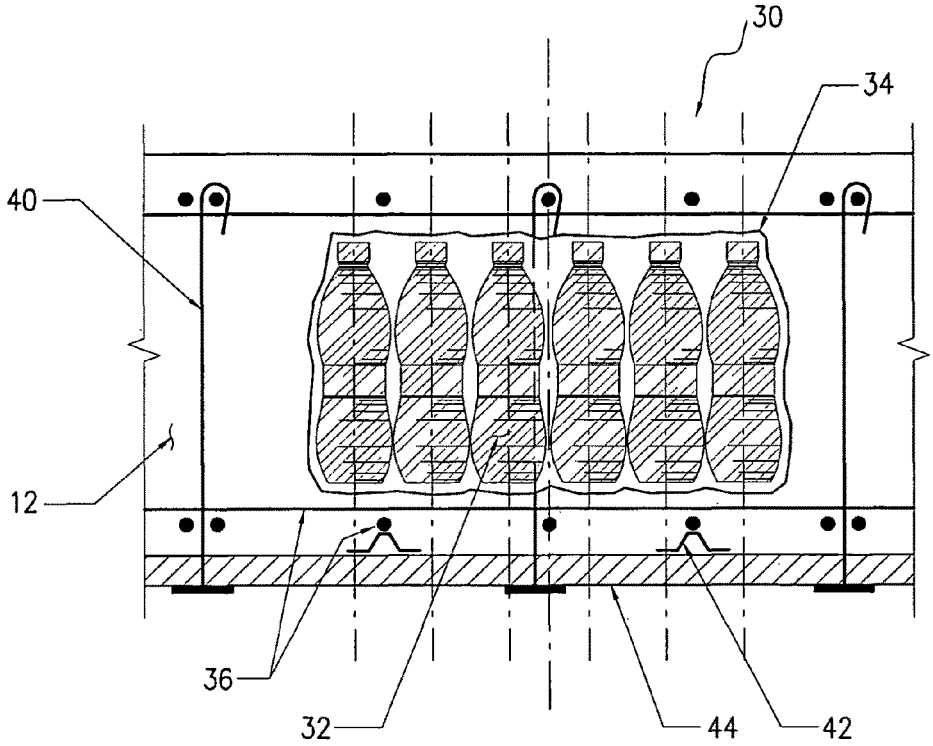
FIG. 5A is a cross sectional view, taken along view lines A, of the sustainable form-inclusion system embodiment 30 of FIG. 4A.

FIG. 5A is a cross sectional view of a sustainable form-inclusion system embodiment 30 showing recycled material 32 placed within reinforcing steel 36. Reinforcing steel 36 is placed above, below, and on each side of the form-inclusion system embodiment 30. Plastic shrink wrap 34 encapsulates the recycled material 32, including sides, top, and bottom. Form ties 40 are used to temporarily connect the sustainable form-inclusion system embodiment 30 to the reinforced concrete structure formwork 44, to prevent buoyancy of sustainable form-inclusion system embodiment 30 during pouring of concrete. Reinforcing bar chairs 42 are used to provide adequate concrete cover to the recycled material 32 encapsulated in plastic shrink wrap 34.

Figure 5B:
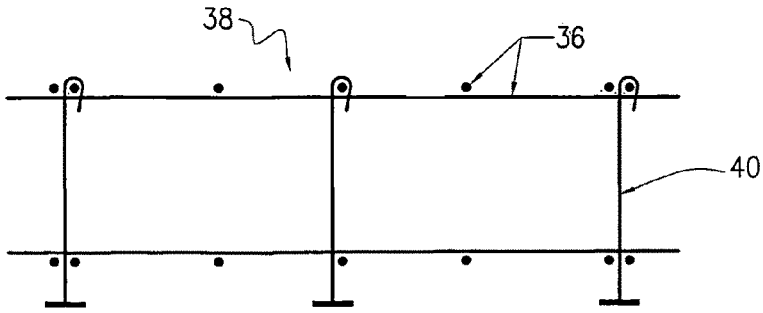
FIG. 5B is a cross-sectional detail of reinforcing steel used at the sustainable form-inclusion system embodiment illustrated in FIG. 5A.

FIG. 5B is a cross-sectional detail of reinforcing steel system 38 used at the sustainable form-inclusion system embodiment 30 illustrated in FIG. 5A. The reinforcing steel system 38 can comprise mild reinforcing steel, high strength pre-stressed cables, or a combination of mild reinforcing steel and high-strength pre-stressed cables. Reinforcing steel 36 is placed above, below, and on each side of the form-inclusion system embodiment 30. Form ties 40 are used to temporarily connect the sustainable form-inclusion system embodiment 30 to the reinforced concrete structure formwork 44, to prevent buoyancy of sustainable form-inclusion system embodiment 30 during pouring of concrete.

Figure 5C:
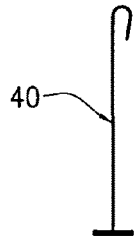
FIG. 5C is a cross-sectional detail of a reinforcing steel tie 40 used to anchor the sustainable form-inclusion system embodiment to the formwork illustrated in FIG. 5A.

FIG. 5C is a cross-sectional detail of a reinforcing steel tie 40 used to anchor the sustainable form-inclusion system embodiment 30 to the formwork 44 illustrated in FIG. 5A.

Figure 6:
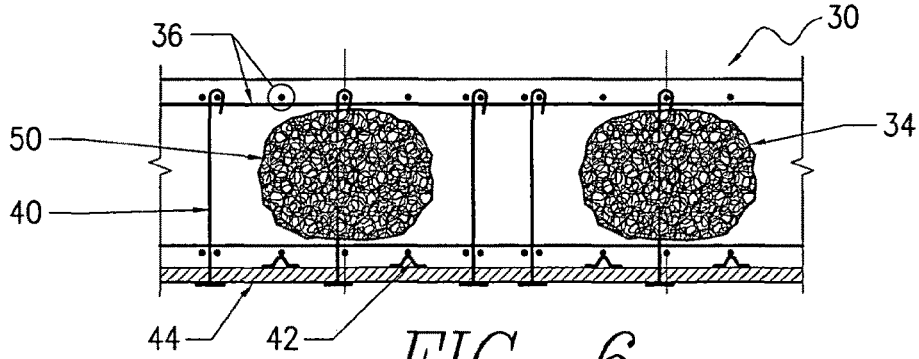
FIG. 6 is a cross sectional view, taken along view lines A, of the sustainable form-inclusion system embodiment of FIG. 4A, illustrating a spherical arrangement of recycled inclusion material.

FIG. 6 is a cross sectional view of a sustainable form-inclusion system embodiment 30, illustrating a spherical arrangement of recycled inclusion material 50. Reinforcing steel 36 is placed above, below, and on each side of the form-inclusion system embodiment 30. Form ties 40 are used to temporarily connect the sustainable form-inclusion system embodiment 30 to the reinforced concrete structure formwork 44, to prevent buoyancy of sustainable form-inclusion system embodiment 30 during pouring of concrete.

Figure 7:
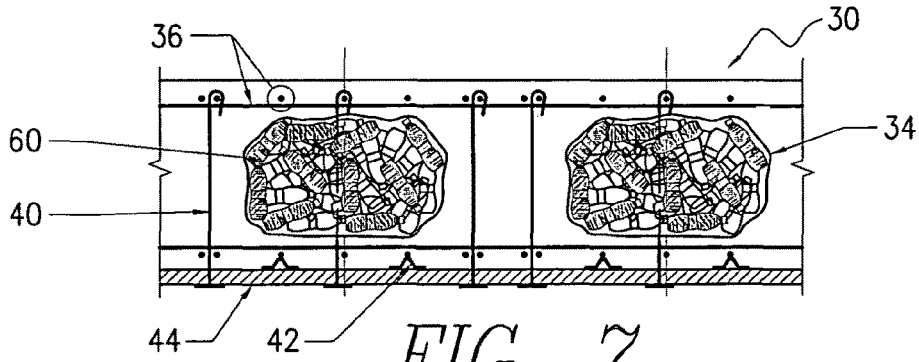
FIG. 7 is a cross sectional view, taken along view lines A, of the sustainable form-inclusion system embodiment of FIG. 4A, illustrating a crushed arrangement of recycled inclusion material.

FIG. 7 is a cross sectional view of a sustainable form-inclusion system embodiment 30, illustrating a crushed recycled inclusion material 60. Reinforcing steel 36 is placed above, below, and on each side of the form-inclusion system embodiment 30. Form ties 40 are used to temporarily connect the sustainable form-inclusion system embodiment 30 to the reinforced concrete structure formwork 44, to prevent buoyancy of sustainable form-inclusion system embodiment 30 during pouring of concrete.

Figure 8:
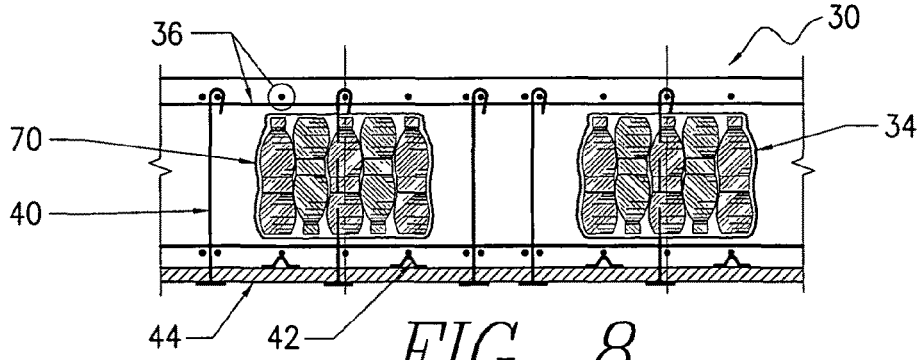
FIG. 8 is a cross sectional view, taken along view lines A, of the sustainable form-inclusion system embodiment of FIG. 4A, illustrating a staggered arrangement of recycled inclusion material.

FIG. 8 is a cross sectional view of a sustainable form-inclusion system embodiment 30, illustrating a staggered recycled inclusion material 70. Reinforcing steel 36 is placed above, below, and on each side of the form-inclusion system embodiment 30. Form ties 40 are used to temporarily connect the sustainable form-inclusion system embodiment 30 to the reinforced concrete structure formwork 44, to prevent buoyancy of sustainable form-inclusion system embodiment 30 during pouring of concrete.

Figure 9:
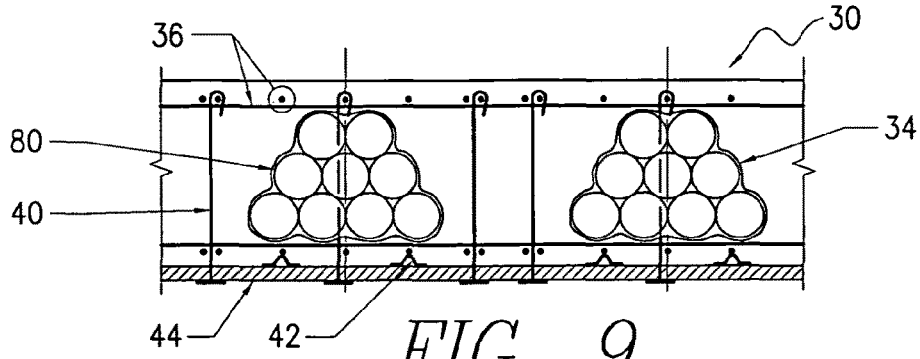
FIG. 9 is a cross sectional view, taken along view lines A, of the sustainable form-inclusion system embodiment of FIG. 4A, illustrating a stacked arrangement of recycled inclusion material.

FIG. 9 is a cross sectional view of a sustainable form-inclusion system embodiment 30, illustrating a stacked recycled inclusion material 80. Reinforcing steel 36 is placed above, below, and on each side of the form-inclusion system embodiment 30. Form ties 40 are used to temporarily connect the sustainable form-inclusion system embodiment 30 to the reinforced concrete structure formwork 44, to prevent buoyancy of sustainable form-inclusion system embodiment 30 during pouring of concrete.

Accordingly, with the introduction of the sustainable form-inclusion system 10 into structures, optimum structural efficiency is achieved while using materials that might otherwise be placed in landfills. Materials are placed in engineered locations and densities to allow the required forces to transfer within the structure. Because the recycled material's density is considerably less than the reinforced concrete's density, the demand on the structure is reduced. Therefore, less structural concrete and steel reinforcing is required for the framed structure, and less structural concrete, reinforcing, and combination of concrete, reinforcing, and structural steel is required for vertical and lateral load-resisting structural elements, including but not limited to columns and walls. Since the mass of the structure is significantly reduced, the demand on the structure's lateral load-resisting system subjected to seismic loads is also reduced. The demand on the foundation system is also less, therefore requiring less structural materials to resist the imposed loads.

It will be understood that the above-described arrangements of apparatus and methods described above are merely illustrative of applications of the principles of this invention, and many other embodiments and modifications may be made without departing form the spirit and scope of the invention as defined in the claims.

For example, the sustainable form-inclusion system 10 described herein may be incorporated into other configurations of framed structures, including slabs spanning in one direction to beam framing consisting of reinforced concrete or structural steel. In addition, framed reinforced concrete slab systems may be supported on reinforced walls or columns consisting of structural steel or a combination of structural steel and concrete. The present sustainable form-inclusion system 10 can be used in reinforced concrete wall construction, in reinforced concrete or post-tensioned beams, and in structures used for roadway construction, such as roads and bridges.

The present sustainable form-inclusion system 10 may use alternate placement configurations based on structural framing conditions and demands. Alternate placements of the sustainable form-inclusion system embodiment 30 may be used in a column strip 14 and/or a middle strip 16 of the structure. The overall configuration does not have to be rectilinear, but may be radial or irregularly spaced. Reinforced concrete or post-tensioned beam framing may be used to span between reinforced concrete columns 12. This framing can include sustainable form-inclusion system embodiments 30. Reinforced concrete walls can be used to support the framed structure in lieu of the reinforced concrete columns 12, with these walls including sustainable form-inclusion system embodiments 30. Alternate recycled materials can be used as filler within sustainable form-inclusion system embodiments 30, including glass, rubber tires, Styrofoam, fiberglass, etc.

What is claimed is:

1. A form-inclusion system comprising a reinforced concrete structure comprising:

a concrete slab; and at least one concrete column supporting and extending through the concrete slab, wherein, the concrete slab is divided into a plurality of zones in a top view based on a relative magnitude of bending moment and shear force in each zone, where each zone includes a plurality of form-inclusion assemblies, a concentration of form-inclusion assemblies in each zone corresponds to a magnitude of the bending moment and shear force that exist within a corresponding zone of the concrete slab thereby forming at least two types of zones including zones with a high concentration of form-inclusion assemblies and zones with a least concentration of form-inclusion assemblies, the at least one concrete column supports at least one of the plurality of zones in which the least concentration of form-inclusion assemblies are placed, and each form-inclusion assembly comprises recycled material and is embedded within the concrete slab.

2. The form-inclusion system of claim 1 wherein the concrete structure is cast in place.

3. The form-inclusion system of claim 1 wherein at least portions of the concrete structure are precast.

4. The form-inclusion system of claim 1 further comprising a plurality of steel ties holding each form-inclusion assembly to its corresponding framed structure during pouring of concrete.

5. The form-inclusion system of claim 1 wherein the recycled material comprises capped plastic bottles.

6. The form-inclusion system of claim 1 wherein the recycled material comprises spherically-formed plastic bags.

7. The form-inclusion system of claim 1 wherein the recycled material comprises crushed plastic bottles.

8. The form-inclusion system of claim 1 wherein the recycled material comprises staggered capped plastic bottles.

9. The form-inclusion system of claim 1 wherein the recycled material comprises stacked capped plastic bottles.

10. The form-inclusion system of claim 1 wherein the reinforced concrete structure comprises a combination of reinforced concrete and structural steel.

11. The form-inclusion system of claim 1 wherein the reinforced concrete structure comprises a composite material.

12. The form-inclusion system of claim 1 wherein each framed structure comprises mild reinforcing steel.

13. The form-inclusion system of claim 1 wherein each framed structure comprises high-strength, pre-stressed cables.

14. The form-inclusion system of claim 1 wherein each framed structure comprises a combination of mild reinforcing steel and high-strength, pre-stressed cables.

15. The form-inclusion system of claim 1 wherein the recycled material is encapsulated in plastic.

* * * * *